US007044807B2

(12) United States Patent
Furuno et al.

(10) Patent No.: US 7,044,807 B2
(45) Date of Patent: May 16, 2006

(54) CIRCUIT BOARD CONNECTOR TERMINAL

(75) Inventors: Tomomi Furuno, Shizuoka (JP); Nobuyuki Sakamoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/113,019

(22) Filed: Apr. 25, 2005

(65) Prior Publication Data

US 2005/0239345 A1 Oct. 27, 2005

(30) Foreign Application Priority Data

Apr. 23, 2004 (JP) ..... 2004-127914

(51) Int. Cl.
*H01R 13/42* (2006.01)

(52) U.S. Cl. ..... 439/751; 439/82

(58) Field of Classification Search ..... 439/82, 439/742, 751, 825, 819
See application file for complete search history.

(56) References Cited

U.S. PATENT DOCUMENTS

| | | | | |
|---|---|---|---|---|
| 3,783,433 | A * | 1/1974 | Kurtz | 439/82 |
| 5,073,119 | A * | 12/1991 | Soes | 439/82 |
| 5,139,446 | A * | 8/1992 | Costello et al. | 439/751 |
| 5,487,684 | A * | 1/1996 | Schalk et al. | 439/751 |
| 6,309,259 | B1 * | 10/2001 | Yamashita | 439/742 |
| 6,629,864 | B1 * | 10/2003 | Schremmer et al. | 439/825 |
| 6,764,318 | B1 * | 7/2004 | Fajardo | 439/82 |
| 2004/0203293 | A1 * | 10/2004 | Hu | 439/751 |

FOREIGN PATENT DOCUMENTS

| | | |
|---|---|---|
| JP | 5-114427 | 5/1993 |
| JP | 8-69828 | 3/1996 |

* cited by examiner

*Primary Examiner*—Tulsidas C. Patel
*Assistant Examiner*—Vladimir Imas
(74) *Attorney, Agent, or Firm*—Armstrong, Kratz, Quintos, Hanson & Brooks, LLP

(57) ABSTRACT

The present invention is to provide a terminal having a stable electric contact without reducing supporting force of the terminal. The terminal is force fitted into a through-hole of a circuit board and connected to conductive portions inside the through-hole electrically. The terminal includes resilient contact portions at both sides of escape spaces formed through in the thickness direction of the insertion portion and the resilient contact portions are elastic along the long axis of the through-hole and are connected with the conductive portions inside the through-hole. The terminal also includes a plurality of leaf spring contact pieces in the escape spaces which are resilient in the short axis of the through-hole and connected electrically to the walls of the through-hole. Locking protrusions are formed at tip end of the insertion portion to engage with an edge of the through-hole. The leaf spring contact pieces have the curved faces which are oriented in opposite directions to each other, and contact to the opposing walls of the through-hole.

7 Claims, 4 Drawing Sheets

CIRCUIT BOARD CONNECTOR TERMINAL

BACKGROUND OF THE INVENTION

1. Field of the Invention

The present invention relates to a circuit board connector terminal (referred to terminal hereafter) to be connected electrically with conductive portions of walls in a through-hole by depressing the terminal into the through-hole of a print circuit board or a circuit board such as a bus bar.

2. Description of the Related Art

A conventional terminal 50 includes a narrow lead 51 at a tip end, a wide insertion portion 52 at a middle point to be force fitted into a through-hole 56, and an electric contact portion 54 at the other end, as shown in FIG. 8A. See, for example, JP,H08-69828,A (page 3, FIG. 5). A thin portion 52*a* is formed in a middle of the width of the insertion portion 52 and both sides thereof are resiliently deformed in the width direction. The width of the through-hole 56 is smaller than that of the insertion portion 52. Then, when the insertion portion 52 enters into the through-hole 56, it deforms inwardly from both sides. The terminal 50 is fixed to a circuit board 55 when an end 53*a* of a shoulder 53 contacts to an upper face 55*a* of the circuit board 55.

Another conventional terminal connected with a conductive portion electrically in a through-hole is disclosed in JP,H05-114427,A (FIG. 2). This terminal deforms elastically and can enter into a small through-hole.

However, the above conventional terminals 50 leave several problems to be solved. The insertion portion 52 supports the terminal 50 and also is connected electrically to the conductive portion in the through-hole 56. Then, if a large supporting force (locking force) is applied to the terminal 50 not to pull out of the through-hole 56, a large insertion force is necessary to depress the terminal 50. If the large insertion force deforms the terminal 50, the electrical contact is lost and the terminal 50 is not reused.

In order to reduce the insertion force of the terminal 50, a slit is formed in the middle portion of the width of the insertion portion 52 to make both sides of the slit bend easily. However, in this case, the supporting force becomes weak and the terminal 50 pulls out of the through-hole 56.

It is intended that the both sides of the insertion portion 52 are in contact with walls of the through-hole 56. However, a front and back face of the insertion portion 52 happen to be not in contact or incomplete contact with the walls of the through-hole 56 and the contact area between the circuit board 55 and the terminal 50 becomes small. If there is a space between the front and back faces of the terminal 50, and the walls of the through-hole 56, the terminal 50 falls over or bend when it is force fitted into the through-hole.

SUMMARY OF THE INVENTION

An object of the present invention is to provide a terminal connecting to a circuit board having a stable electrical contact and reusability without reducing a terminal supporting force.

To achieve the foregoing object, according to a first aspect of the present invention, a terminal has resilient contact portions to be force fitted into a through-hole of a circuit board and connected electrically to conductive portions of walls of the through-hole, wherein the resilient contact portions are arranged at both sides of escape spaces formed through in the thickness direction of the terminal and resilient in the width direction of the terminal, and have leaf spring contact pieces to be connected to the conductive portions of the walls of the through-hole.

Thereby, the terminal force fitted into the through-hole is stably supported by a spring force of the resilient contact portions in a width direction of the terminal and a spring force of the leaf spring contact pieces in a thickness direction of the terminal. Since the resilient contact portions and the leaf spring contact pieces contact to the conductive portions of the walls of the through-hole, the terminal contacts to the circuit board with wide area. The leaf spring contact pieces abut to the walls of the through-hole with the spring force and support resiliently the terminal which has a low flexural rigidity at the thickness direction, and it is prevented the terminal from falling over or bending when the terminal is force fitted into the through-hole.

According to a second aspect of the present invention, the plurality of leaf spring contact pieces have curved contact faces and arranged in parallel to each other, and the curved contact faces are oriented in opposite directions to each other.

Thereby, the each leaf spring contact piece abuts to the opposing wall in the through-hole with the spring force and supports stably the terminal in the thickness direction thereof.

According to a third aspect of the present invention, the resilient contact portions have locking portions at tip end to be engaged with an edge of the through-hole. Thereby, it is prevented the terminal from pulling out of the through-hole.

According to a fourth aspect of the present invention, a terminal has a main body and a leaf spring contact member which is attached to the main body and force fitted into a through-hole of a circuit board and connected electrically to conductive portions of walls of the through-hole, wherein the leaf spring contact member has a pair of contact pieces opposed to each other which are resilient and connected by a hinge and hold the main body.

Thereby, when the terminal is force fitted into the through-hole, the pair of the leaf spring contact member bends and contacts to the conductive portions of the walls of the through-hole with wide area. The terminal which has a low flexural rigidity in the thickness direction is prevented from falling over or bending when it is force fitted into the through-hole.

According to a fifth aspect of the present invention, the pair of contact pieces are connected by a resilient hinge.

Thereby, the pair of contact pieces bend at the resilient hinge as a fulcrum, the contact pieces easily bend in the thickness direction of the terminal.

According to a sixth aspect of the present invention, resilient contact portions are formed at both sides of the main body and in contact with the conductive portions of the walls of the through-hole.

Thereby, the terminal force fitted into the through-hole is stably supported by a spring force of the resilient contact portions in a width direction of the terminal and a spring force of the leaf spring contact pieces in a thickness direction of the terminal. Since the resilient contact portions and the leaf spring contact pieces contact to the conductive portions of the walls of the through-hole, the terminal contacts to the circuit board with wide area.

According to a seventh aspect of the present invention, the main body has an engaging portion to be engaged with locking portions of the leaf spring contact member. Thereby, the leaf spring contact member is locked to the main body.

According to an eighth aspect of the present invention, the main body has a positioning groove at tip end to be fitted to the hinge of the leaf spring contact member. Thereby, the leaf spring contact member is positioned with respect to the width direction of the terminal.

DESCRIPTION OF THE PREFERRED EMBODIMENTS

Figure 1:
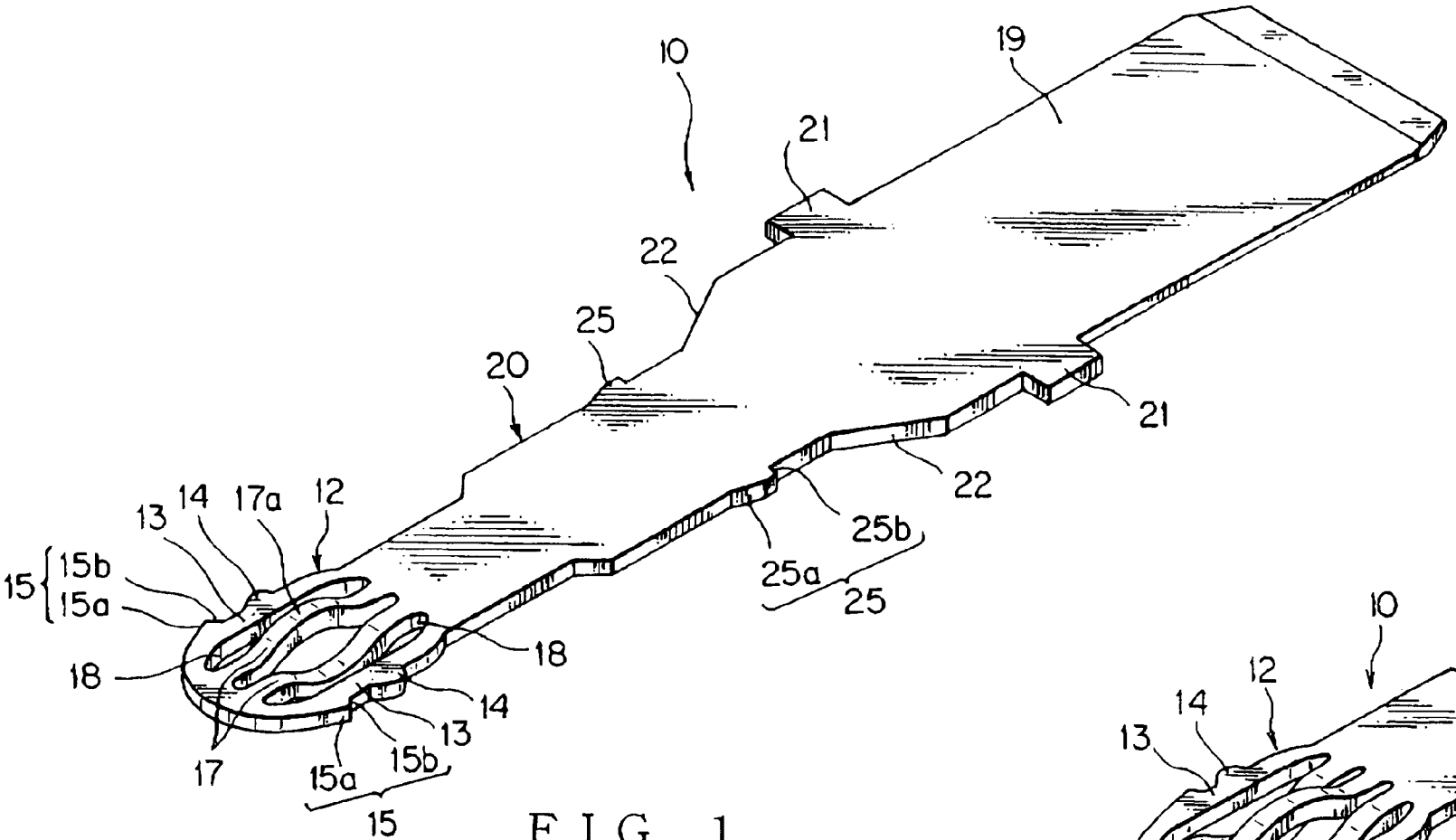
FIG. 1 is a perspective view of a first embodiment of a terminal according to the present invention.
Figure 2:
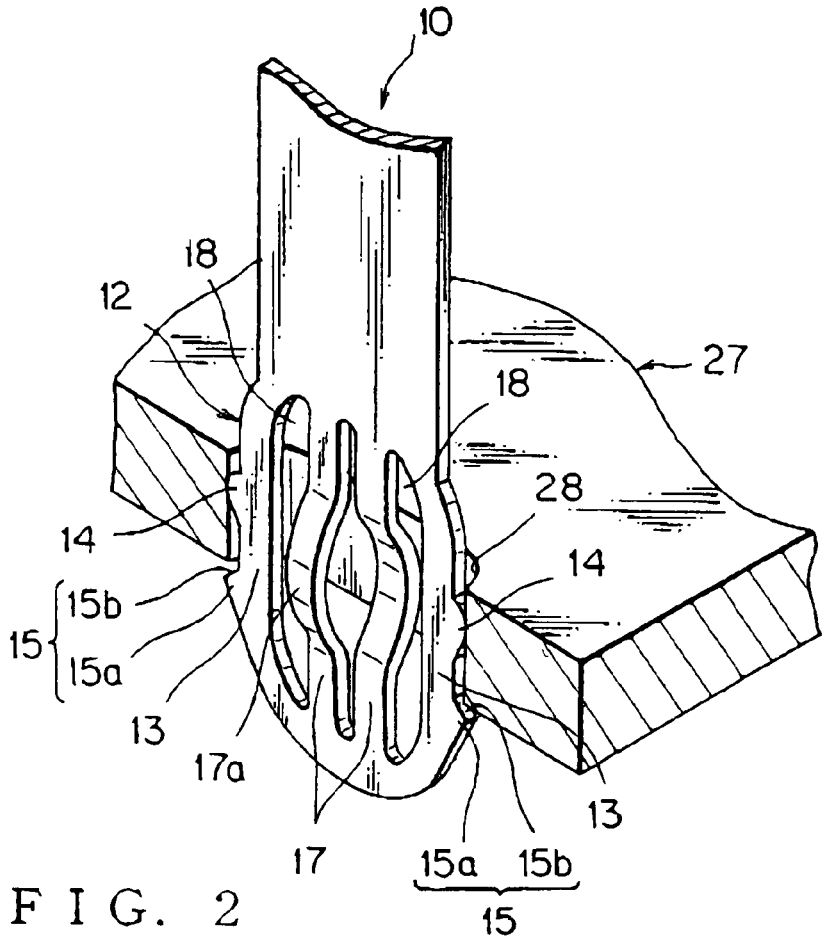
FIG. 2 is a partially sectional view showing that the terminal of FIG. 1 is force fitted into a bus bar.

Embodiments of the present invention are explained referring to drawings. FIGS. 1 and 2 show a first embodiment of a terminal connecting to a circuit board according to the present invention.

A terminal 10 is also referred to a press-fit terminal or press-in terminal. The terminal 10 is force fitted into a through-hole 28 in a bus bar 27 (circuit board) or a print circuit board (not shown) and is connected to the circuit board 27 electrically to supply a power from a battery or to carry electric signals without soldering. The terminal 10 is made of a conductive metal such as brass, phosphor bronze, copper alloy such as beryllium copper, or aluminum alloy. It is formed by punching and pressing the conductive material. The terminal 10 of the embodiment supplies the electric power to the bus bar 27 of a circuit in an electric connector box such as a junction box or a fuse box, and drives electric parts such as fuse or relay and electronic parts such as semiconductors.

The bus bar 27 is a conductive board forming a given circuit pattern in the electric connection box arranged in a engine room or underneath a vehicle interior. It is formed by pressing a copper alloy or aluminum alloy with high conductivity into the circuit pattern.

The bus bar 27 is arranged in layers in the electric connection box and forms a complicated circuit therein. An upper and lower bus bar in the layer are connected to each other by a trunk terminal which is connected to an electric contact portion 19 of the terminal 10 or an upstanding tab shape electric contact portion (not shown) formed integrally with the circuit. A connector receiving a female terminal is attached to an uppermost or lowermost bus bar and the female terminal is connected electrically to the electric contact portion 19.

The electric contact portion integrated to the bus bar 27 is bent at an end of the bus bar 27. The electric contact portion 19 of the terminal 10 is force fitted into the through-hole 28 formed in any given position of the bus bar 27 and then the circuit pattern is easily made so that the circuit design for changing types or grades of vehicles can be easily made.

The terminal 10 has an insertion portion 12 to be force fitted into the through-hole 28 of the bus bar 27 at tip end, the electric contact portion 19 to be connected to a complementary terminal at the other end, and a body 20 between the insertion portion 12 and the electric contact portion 19. The body 20 has links 21, which connect other terminals before separating the terminal 10, at both sides in the middle portion thereof.

As shown in FIG. 1, the insertion portion 12 has a slightly larger width than that of the through-hole 28 and deforms resiliently in the width direction of the terminal 10 at both sides of escape spaces 18 which are formed at the end of the terminal 10 and formed through the end in the thickness direction of the terminal 10. The insertion portion 12 includes resilient contact portions 13 to connect electrically to conductive portions in the through-hole 28, a plurality of leaf spring contact pieces 17 which deform resiliently in the thickness direction of the insertion portion 12 in the escape spaces 18, and locking protrusions 15 (locking portions) to be locked to an edge of the through-hole 28, locating at the distal end of the insertion portion 12.

The resilient contact portions 13 each are formed in an arcuate shape and include an outwardly extending contact protrusion 14 in a middle position thereof in the width direction of the insertion portion 12. The thickness and the spring force of the resilient contact portions 13 are thicker and larger than those of the leaf spring contact pieces 17, respectively. For this reason, the terminal 10 has a large contact pressure in the width direction than the thickness direction and is held strongly in the width direction. Meanwhile, the leaf spring contact pieces 17 have a large contact area with the walls of the through-hole 28.

As shown in FIG. 2, when the insertion portion 12 is force fitted into the through-hole 28 and the contact protrusions 14 abut to the walls of the through-hole 28, the middle portions of the resilient contact portions 13 bend inwardly to narrow the escape spaces 18 as like as a supported beam is subjected to a concentrated load. Thereby, the terminal 10 is supported resiliently by the through-hole 28 in the width direction. Since the terminal 10 has a large flexural rigidity in the width direction due to the second moment in the cross section, it is prevented the terminal 10 from falling and deforming in the width direction.

At the both sides of the resilient contact portions 13, the locking protrusions 15 protrude at positions apart from the contact protrusions 14 to the tip end side of the terminal 10. The locking protrusions 15 prevent the terminal 10 from pulling out of the through-hole 28 and the extension of the protrusions 15 is almost same as that of the contact protrusions 14. Each locking protrusion 15 has slopes 15*a* and 15*b* at both sides thereof which assists the insertion portion 12 to enter into the through-hole 28. The slopes 15*a* function to guide the insertion portion 12 to enter into the through-hole 28 and the slopes 15*b* function to hold the insertion portion 12 not to pull out of the through-hole 28.

Two side-by-side leaf spring contact pieces 17 are arranged in the middle of the insertion portion 12 along the lengthwise direction of the terminal 10 and both ends thereof are integral to the insertion portion 12. The leaf spring contact pieces 17 provide the spaces 18 for the resilient contact portions 13 to deform inwardly. Each leaf spring contact piece 17 is arch-shaped. The leaf spring contact pieces 17 have slightly curved contact faces 17*a* which are oriented in the opposite directions to each other and contact to each opposing wall in the through-hole 28 to hold the terminal 10.

The curved contact faces 17*a* are force fitted when the insertion portion 12 is force fitted into the through-hol2 28. Since the leaf spring contact pieces 17 each have the oppositely oriented curved face, the insertion portion 12 is urged by the both walls of the through-hole 28 in the width direction.

The thickness of the leaf spring contact pieces 17 is thinner than that of the resilient contact portions 13 and its spring force is smaller than that of the resilient contact portions 13 so that the insertion portion 12 is easily force fitted into the through-hole 28.

The width, length and curvature of the leaf spring contact pieces 17 are decided based on the spring force and a contact area with the walls of the through-hole 28.

Figure 3:
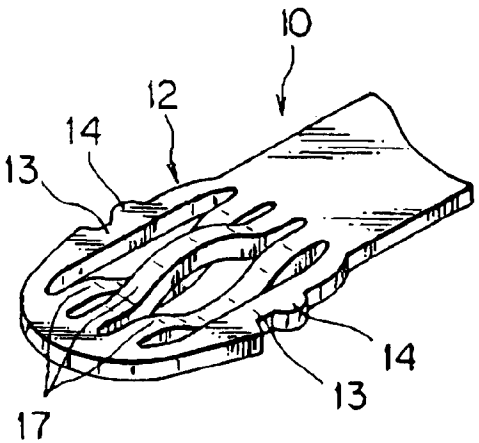
FIG. 3 is a perspective view showing a modification of an insertion portion of the terminal in FIG. 1.

The number of the leaf spring contact pieces 17 is optional, FIG. 3 showing three pieces, the number more than three is also acceptable. As the number of the leaf spring contact pieces 17 increases, the width thereof 17 becomes narrower and the spring force becomes smaller so that the leaf spring contact pieces 17 can contact weakly with the walls of the through-hole 28.

The electric contact portion 19 at the other end of the terminal 10 is connected to a complementary female terminal (not shown) and has a width larger than that of the insertion portion 12. The width of the electric contact portion 19 varies with the current and voltage applied thereto and is larger than that of the contact portion for signals so that the electric contact portion 19 assuredly supply the power from the battery to the bus bar 27.

Figure 4:
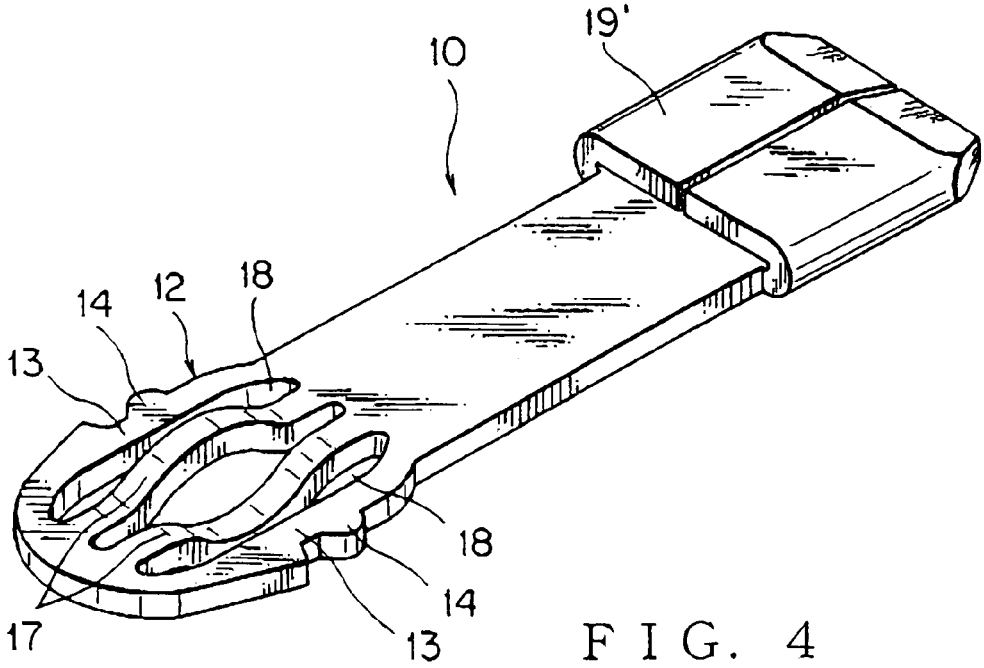
FIG. 4 is a perspective view showing a modification of an electric contact portion of the terminal in FIG. 1.
Figure 5:
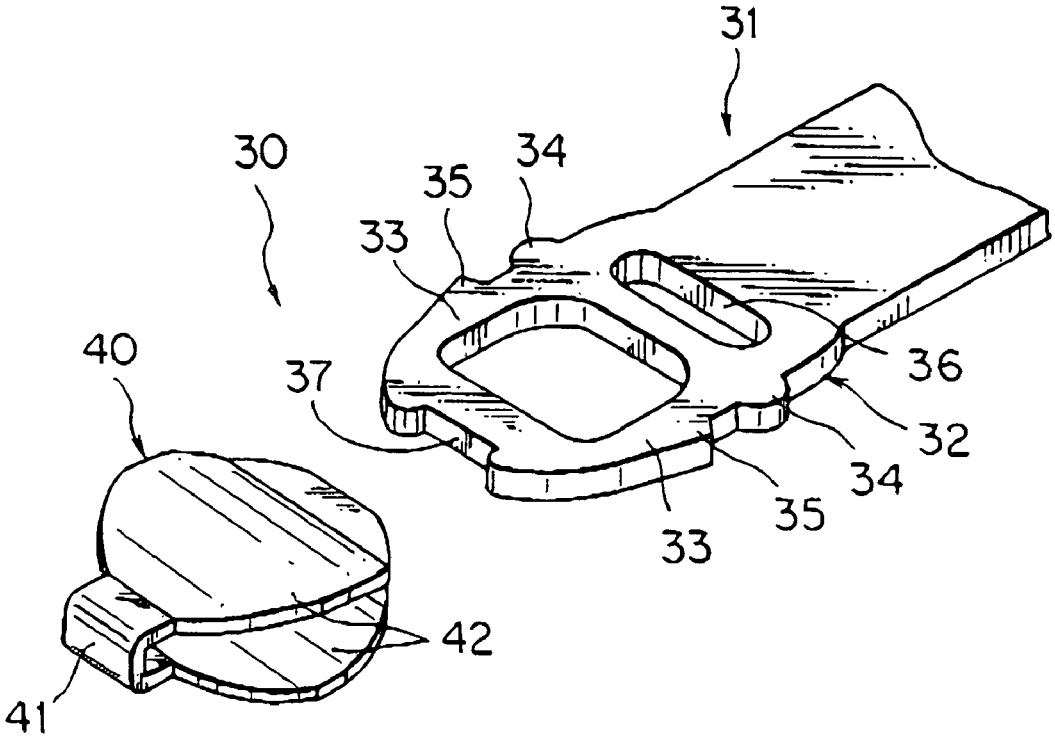
FIG. 5 is an exploded perspective view showing a second embodiment of a terminal according to the present invention.
Figure 6:
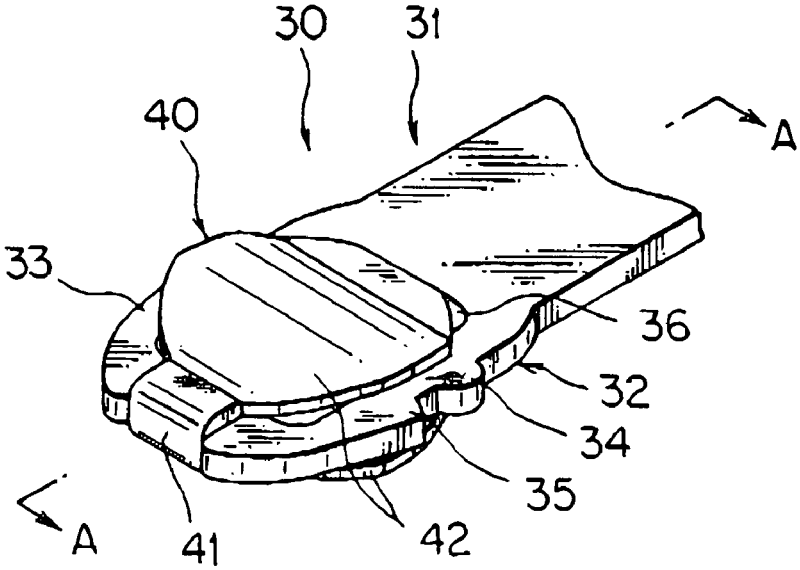
FIG. 6 is a perspective view showing an integration of the terminal shown in FIG. 5.
Figure 7:
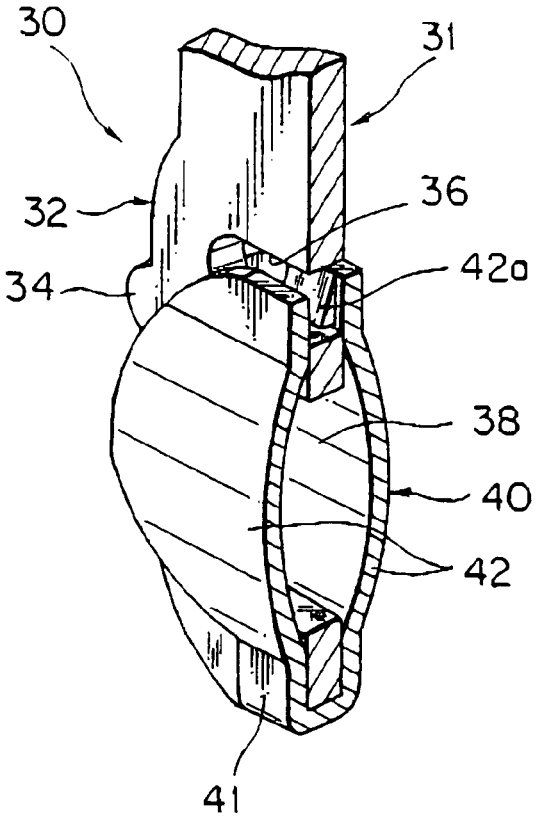
FIG. 7 is a sectional view taken along the line A—A in FIG. 6.
Figure 8A:
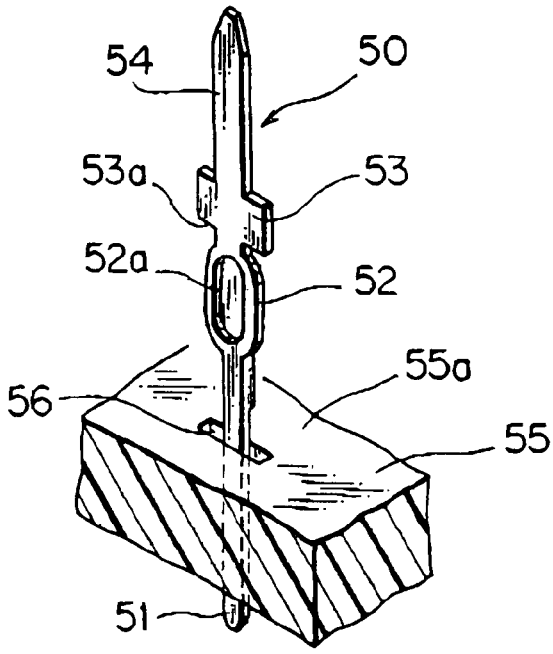
PRIOR ART FIG. 8A
FIG. 8A is a perspective view before a terminal is force fitted into a through-hole in a conventional terminal.
Figure 8B:
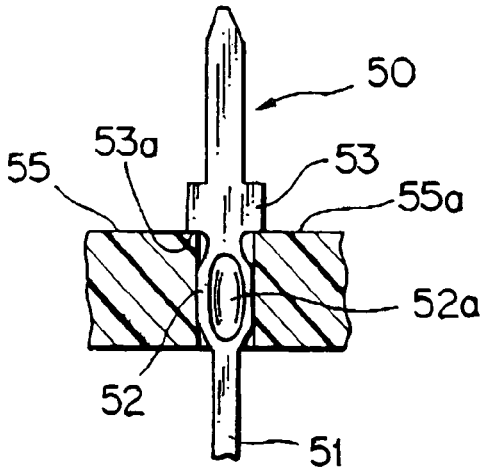
PRIOR ART FIG. 8B
FIG. 8B is a sectional view after the terminal is force fitted into the through-hole.

FIG. 4 shows a modification of an electric contact portion 19'. The electric contact portion 19' having outwardly extending portions at both ends is formed by a press and the extending portions are folded inwardly by bending. The thickness of the electric contact portion 19' is twice as that of the electric contact portion 19 in FIG. 1. With increase of the thickness of the electric contact portion 19', high current and high voltage are reliably supplied to the bus bar 27.

The body 20 is located between the insertion portion 12 and the electric contact portion 19 and gradually becomes wider from the insertion portion 12 to the electric contact portion 19. Holding protrusions 25 are formed between the insertion portion 12 and the links 21. They engage with an insulating board (not shown) disposed above the bus bar 27 at both sides thereof and prevent the terminal 10 from pulling out of the board. Each of the holding protrusions 25 has a slope 25*a* which makes an easy insertion for the terminal 10, and a vertical locking face 25*b* following from the slope 25*a*. The electric contact portion 19 follows from taper portions 22 through the holding protrusions 25.

According to the terminal 10 of the first embodiment, when the insertion portion 12 is force fitted into the through-hole 28, it is supported resiliently by the walls of the through-hole 28 at both sides of the width and thickness thereof so that it is inserted into the through-hole 28 smoothly without falling to or bending. When the insertion portion 12 is in the through-hole 28, the resilient contact portions 13 which are resilient in the width direction of the terminal 10 abut to the both walls of the through-hole 28 along a long axis of the through-hole 28 with a strong spring force so that the insertion portion 12 is strongly held by a large contact pressure. The leaf spring contact pieces 17 which are resilient in the direction of the thickness of the terminal 10 abut to the both walls of the through-hole 28 along a short axis of the through-hole 28 in the deflecting spaces 18 of the insertion portion 12 with a weak spring force so that the contact area between the leaf spring contact pieces 17 and the walls of the through-hole 28 increases and the contact stability of the insertion portion 12 is improved. Then, the stability of the electric contact is improved without reducing the supporting force of the terminal.

A second embodiment of a terminal according to the present invention is described in the following. The same parts in the second and the first embodiment utilize the same numerals and the explanations are omitted. The features of the second embodiment differ to the first embodiment with respect that a terminal 30 includes a main body 31 and a leaf spring contact member 40.

The main body 31 and the leaf spring contact member 40 are formed by pressing conductive metals such as copper and by bending as necessary. The main body 31 includes a insertion portion 32 having a engaging hole (engaging portion) 36 engaging with the leaf spring contact member 40 at tip end and the electric contact portion 19 (not shown) at the other end as in FIG. 1.

At the insertion portion 32, resilient contact portions 33 are formed at both sides of a escape space 38 formed through the insertion portion 32. The resilient contact portions 33 are almost same as the resilient contact portions 13 in FIG. 1 but each has two outwardly extending contact protrusions 34 and 35. The number of the contact protrusions 34 and 35 formed is optional, may be one contact protrusion, and the increase number thereof increases the supporting force of the terminal.

The extended engaging hole 36 to engage with a locking claw 42*a* of the leaf spring contact member 40 is formed in one side of the escape space 38 of the insertion potion 32. The engaging of the locking claw 42*a* to the engaging hole 36 prevents the leaf spring contact member 40 from pulling out of the insertion portion 32.

The insertion portion 32 has a positioning groove 37 at the end thereof which positions the leaf spring contact member 40 in the width direction of the terminal and engages with the leaf spring contact member 40. Both edges of the positioning groove 37 are curved for guiding and being engaged easily with a hinge 41 of the leaf spring contact member 40. When the leaf spring contact member 40 is attached to the insertion portion 32, the hinge 41 engages inside the positioning groove 37 without extending from both edges thereof.

The leaf spring contact member 40 has a pair of contact pieces 42 which are opposed to each other at both ends of the hinge 41 which is formed in U-shaped and resilient. Each contact piece 42 is a disk shape, curved outwardly, and resilient inwardly at the hinge 41. The curved faces of the contact pieces 42 contact to the walls of the short axis of the through-hole 28.

Each contact piece 42 has the locking claw 42*a* which engages with the engaging hole 36 and extends inwardly from an inner face thereof. Each opposing locking claw 42*a* is out of alignment to prevent the interference each other.

The thickness of the contact pieces 42 is thinner than that of the resilient contact portion 33 and easily bent so that the contact pieces 42 contact to the walls of the through-hole 28 with wide area. The resilient contact portions 33 are hard to deform elastically and contact to the walls of the through-hole 28 with large contact pressure. Thereby, the terminal 30 is strongly supported inside the through-hole 28.

According to the second embodiment of the terminal 30, when the terminal 30 is force fitted into the through-hole 28, the pair of the contact pieces 42 are bent and contact more widely to the walls of the through-hole 28 and improve the electrical contact.

The present invention is not limited to the above embodiments. In the second embodiment, the leaf spring contact member 40 has the pair of the contact pieces connected through the resilient hinge 41. However, the pair of the contact pieces may be connected directly without the hinge. In this case, the contact pieces are easily pressed in a conductive plate and easily bent to form the leaf spring contact member so that the leaf spring contact member is made smaller.

What is claimed is:

1. A circuit board connector terminal comprising, an insertion portion, a body, and an electric contact portion;

the insertion portion having resilient contact portions and leaf spring contact pieces, the contact portions being arranged at both sides of escape spaces formed through in a thickness direction of the insertion portion and resilient in a width direction of the insertion portion, the contact portions and the leaf spring contact pieces being connected electrically to conductive portions of walls of the through-hole, the insertion portion being force fitted into a through-hole of a circuit board at tip end of the terminal, the body being positioned between the insertion portion and the electric contact portion, the body having links adjacent to the electric contact portion and gradually becoming wider from the insertion portion to the electric contact portion, the electric contact portion being connected to a complementary terminal at the other end, wherein when the insertion portion is force fitted into a through-hole of a circuit board, the leaf spring contact pieces abut the walls of the through-hole, the spring force of which resiliently supports the terminal.

2. The insertion portion as claimed in claim 1, wherein said plurality of leaf spring contact pieces have curved contact faces, the spring contact pieces are arranged side-by-side in the middle portion along the lengthwise direction of the terminal, the curved faces are arched around the lengthwise axis of the insertion portion, and the curved contact faces are oriented in opposite directions to each other.

3. The insertion portion as claimed in claim 1, wherein said resilient contact portions include one or more contact protrusions outwardly extending in a middle position in the width direction of the insertion portion, and locking protrusions at tip end thereof to be engaged with an edge of the through-hole and at both sides of the resilient contact portions, the locking protrusions protrude at positions spaced apart from the contact protrusions and extend to the tip end, each locking protrusion have slopes at both sides thereof which assist the insertion portion in entering into the through-hole.

4. A circuit board connector terminal comprising an electric contact portion, a main body, and a leaf spring contact member, the main body extending to an insertion portion having an engaging hole at tip end thereof and resilient contact portions, the leaf spring contact member having a locking portion which engages to the engaging hole to prevent the leaf spring contact member from pulling out of the insertion portion, the leaf spring contact member having a pair of contact pieces opposed each other and resilient in a thickness direction of the main body, the leaf spring contact member being force fitted into a through-hole of a circuit board and connected electrically to conductive portions of walls of the through-hole by the contact pieces, wherein when the insertion portion is in the through-hole, the resilient contact portions are resilient in a width direction of the terminal and abut the walls of the through-hole along a long axis of the through-hole with a spring force so that the insertion portion is held by contact pressure.

5. The terminal as claimed in claim 4, wherein said pair of contact pieces are connected through a resilient hinge.

6. The terminal as claimed in claim 4, wherein resilient contact portions are formed at both sides of the main body and in contact with the conductive portions of the walls of the through-hole.

7. A circuit board connector terminal comprising an electric contact portion, a main body, and leaf spring contact member, the main body extending to an insertion portion having an engaging hole at tip end thereof and resilient contact portions, the tip end having a positioning groove to be fitted to a hinge of the leaf spring contact member, the leaf spring contact member having a locking claw which engages to the engaging hole to prevent the leaf spring contact member from pulling out of the insertion portion, the leaf spring contact member having a pair of contact pieces opposed to each other and connected through a resilient hinge, the contact pieces being resilient in a thickness direction of the main body, the leaf spring contact member being force fitted into a through-hole of a circuit board and connected electrically to conductive portions of walls of the through-hole by the contact pieces, wherein when the insertion portion is in the through-hole, the resilient contact portions are resilient in the width direction of the terminal and abut the walls of the through-hole along a long axis of the through-hole with a spring force so that the insertion portion held by contact pressure.

* * * * *